US006862950B2

(12) United States Patent
O'Neill

(10) Patent No.: US 6,862,950 B2
(45) Date of Patent: Mar. 8, 2005

(54) ADJUSTABLE PEDAL ASSEMBLY

(75) Inventor: Dan O'Neill, Chatham (CA)

(73) Assignee: KSR Industrial Corporation, Southfield, MI (US)

( * ) Notice: Subject to any disclaimer, the term of this patent is extended or adjusted under 35 U.S.C. 154(b) by 156 days.

(21) Appl. No.: 10/287,103

(22) Filed: Nov. 4, 2002

(65) Prior Publication Data

US 2003/0094070 A1 May 22, 2003

Related U.S. Application Data

(60) Provisional application No. 60/336,205, filed on Nov. 2, 2001.

(51) Int. Cl.[7] ..... G05G 1/14

(52) U.S. Cl. ..... 74/512; 74/513

(58) Field of Search ..... 74/512, 513, 560, 74/561, 562

(56) References Cited

U.S. PATENT DOCUMENTS

| | | | | |
|---|---|---|---|---|
| 4,470,570 | A | 9/1984 | Sakurai | 244/235 |
| 4,528,590 | A | 7/1985 | Bisacquino et al. | 338/153 |
| 4,883,037 | A | 11/1989 | Mabee et al. | 123/399 |
| 4,915,075 | A | 4/1990 | Brown | 123/399 |
| 4,938,304 | A | 7/1990 | Yamaguchi et al. | 180/197 |
| 4,958,607 | A | 9/1990 | Lundberg | 123/399 |
| 4,969,437 | A | 11/1990 | Kolb | 123/399 |
| 4,986,238 | A | 1/1991 | Terazawa | 123/361 |
| 5,056,742 | A | 10/1991 | Sakurai | 244/235 |
| 5,063,811 | A | 11/1991 | Smith et al. | 74/513 |
| 5,215,057 | A | 6/1993 | Sato et al. | 123/400 |
| 5,233,882 | A | 8/1993 | Byram et al. | 74/514 |
| 5,241,936 | A | 9/1993 | Byler et al. | 123/399 |
| 5,385,068 | A | 1/1995 | White et al. | 74/512 |
| 5,460,061 | A | 10/1995 | Redding et al. | 74/512 |
| 5,632,183 | A | 5/1997 | Rixon et al. | 74/512 |
| 5,771,752 | A | 6/1998 | Cicotte | 74/512 |
| 5,819,593 | A | 10/1998 | Rixon et al. | 74/514 |
| 5,884,532 | A | 3/1999 | Rixon et al. | 74/512 |
| 5,887,488 | A | 3/1999 | Riggle | 74/514 |
| 5,927,154 | A | 7/1999 | Elton et al. | 74/512 |

(List continued on next page.)

FOREIGN PATENT DOCUMENTS

| | | |
|---|---|---|
| DE | 1 975 7084 | 6/1999 |
| EP | 0 918 273 | 5/1999 |
| FR | 95 12130 | 4/1997 |

OTHER PUBLICATIONS

1974 Pontiac Service Manual

*Primary Examiner*—David A. Bucci
*Assistant Examiner*—Vicky A. Johnson
(74) *Attorney, Agent, or Firm*—Gifford, Krass, Groh, Sprinkle, Anderson & Citkowski, P.C.

(57) ABSTRACT

An adjustable pedal assembly for a vehicle includes a support bracket having a top wall, a bottom wall, a rear wall, and a pair of opposed side walls. The pedal assembly includes a carrier bracket slidingly supported by the support bracket, and the carrier bracket includes a generally inclined front wall, a floor extending from a lower edge of the front wall, and a pair of opposed side walls extending between the front wall and the floor. The carrier assembly also includes a pedal pivotally attached to the carrier bracket along a pivot axis that extends longitudinally therealong the carrier bracket. The carrier assembly further includes a pedal adjustment mechanism operatively attached to the carrier bracket, for adjusting the position of the carrier bracket relative to the support bracket to adjust the position of the pedals along a predetermined path.

32 Claims, 2 Drawing Sheets

U.S. PATENT DOCUMENTS

| | | | | |
|---|---|---|---|---|
| 5,996,438 | A | 12/1999 | Elton | 74/512 |
| 6,019,015 | A | 2/2000 | Elton | 74/513 |
| 6,073,515 | A | 6/2000 | Elton et al. | 74/564 |
| 6,109,241 | A | 8/2000 | Engelgau | 123/399 |
| 6,151,984 | A | 11/2000 | Johansson et al. | 74/512 |
| 6,151,986 | A | 11/2000 | Willemsen et al. | 74/512 |
| 6,173,625 | B1 | 1/2001 | McFarlane et al. | 74/512 |
| 6,178,847 | B1 | 1/2001 | Willemsen et al. | 74/512 |
| 6,289,761 | B1 | 9/2001 | Reynolds et al. | 74/512 |
| 6,289,763 | B1 | 9/2001 | Rixon et al. | 74/514 |
| 6,305,239 | B1 | 10/2001 | Johansson et al. | 74/512 |
| 6,321,617 | B1 | 11/2001 | Schwyn | 74/512 |
| 6,364,047 | B1 * | 4/2002 | Bortolon | 180/334 |
| 6,374,695 | B1 | 4/2002 | Johansson et al. | 74/512 |
| 6,389,927 | B1 | 5/2002 | Willemsen | 74/514 |
| 6,450,061 | B1 * | 9/2002 | Chapman et al. | 74/512 |
| 2003/0084744 | A1 * | 5/2003 | Parenteau et al. | 74/512 |
| 2004/0031350 | A1 * | 2/2004 | Williams et al. | 74/560 |

* cited by examiner

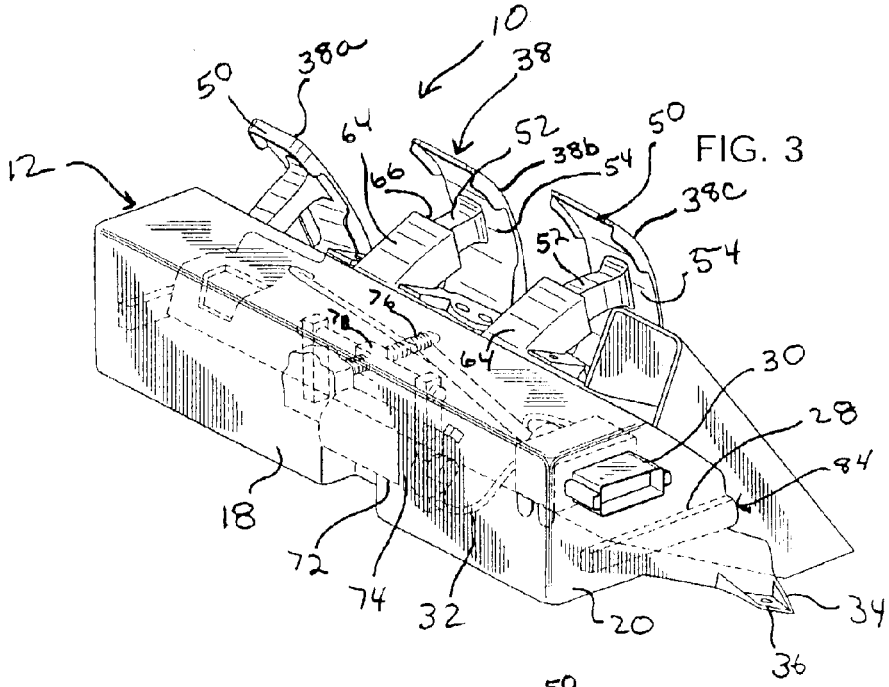
FIG. 3
FIG. 4
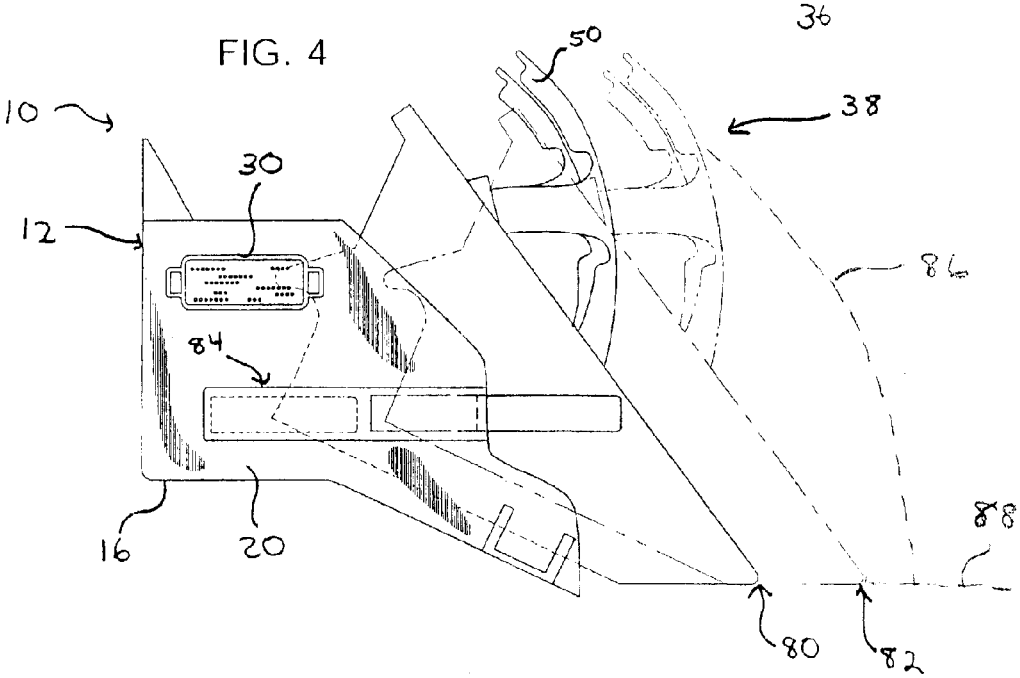

ADJUSTABLE PEDAL ASSEMBLY

RELATED INVENTION

This application claims priority of U.S. Provisional Patent Application 60/336,205 filed Nov. 2, 2001, entitled "Pedal Adjuster" and is incorporated herein by reference.

FIELD OF INVENTION

This invention relates to pedals, and more particularly to an adjustable pedal assembly for a vehicle that is floor mounted.

BACKGROUND OF THE INVENTION

Vehicles, such as motor vehicles, typically contain foot-actuated devices or pedals for controlling various functions of the vehicle. These functions are known to include: acceleration, controlled by an accelerator pedal; braking, controlled by a brake pedal; and shifting, controlled by a clutch pedal. In addition, the vehicle may include a non-functional pedal that serves as a foot rest for the driver. These pedals are positioned in the vehicle so that they are accessible by the driver. However, drivers come in a wide variety of shapes and sizes, and a pedal positioned to accommodate a large driver with a large foot will generally be unreachable by a small driver with a small foot. In the past, the pedals were fixedly positioned so that the majority of drivers were accommodated, from a functional and ergonomic perspective. The functionality of the pedal relates to the ability of the driver to reach and actuate the pedal. The ergonomics of the pedal relates to factors such as the driver's comfort while actuating the pedal, as measured by foot angle.

More recently, adjustable pedals have been used in vehicles to accommodate a greater number of drivers. The driver can modify the position of the pedals either closer to the driver, or away from the driver. However, it is essential that the dimensional relationships between the pedals are maintained during adjustment, such as, the height relationship between each of the pedals. An example of such an adjustable pedal is disclosed in commonly assigned U.S. Pat. No. 6,151,986 to KSR International, Inc. entitled "Adjustable Vehicle Control Pedals," the disclosure of which is incorporated herein by reference. This type of adjustable pedal works well, and includes an adjustment mechanism comprising a motor, a drive mechanism operatively connected to the motor and a screw mechanism operatively connected to the pedal. The adjustable pedal may be a single pedal, or multiple pedals with common pedal adjustment components. In the past, a separate screw mechanism was operatively connected to each pedal, to adjust the position of each pedal. However, due to the additive effect of tolerances in the adjustable pedal assembly, there could be a slight variation in the dimensional relationship between the pedals at an extreme adjustment position.

Thus, there is a need in the art for an ergonomically beneficial adjustable pedal assembly that is floor mounted and utilizes an integral adjustment mechanism to maintain the dimensional relationship between each of the pedals at every adjustment point.

SUMMARY OF THE INVENTION

Accordingly, the present invention is a floor mounted adjustable pedal assembly. The adjustable pedal assembly includes a support bracket adapted for mounting on a vehicle, and the support bracket includes a top wall, a bottom wall opposite the top wall, a rear wall extending between the top wall and bottom wall, and a pair of opposed side walls extending between the top wall and bottom wall. The pedal assembly includes a carrier bracket slidingly supported by the support bracket, and the carrier bracket includes a generally inclined front wall, a floor extending from a lower edge of the front wall, and a pair of opposed side walls extending between the front wall and the floor. The carrier assembly also includes a pedal pivotally attached to the carrier bracket along a pivot axis that extends longitudinally therealong the carrier bracket. The carrier assembly further includes a pedal adjustment mechanism operatively attached to the carrier bracket, for adjusting the position of the carrier bracket relative to the support bracket to adjust the position of the pedal along a predetermined path.

One advantage of the present invention is that a floor mounted adjustable pedal assembly is provided with pedals that can be ergonomically positioned to accommodate a variety of drivers. Another advantage of the present invention is that a floor mounted adjustable pedal assembly is provided whereby the dimensional relationship of each pedal with respect to each other is automatically maintained as the pedal position is adjusted by the driver. A further advantage of the present invention is that a floor mounted adjustable pedal assembly is provided with improved packageability. Still a further advantage of the present invention is that the pedals are housed in a unitary assembly and are adjusted using a common adjustment mechanism. Yet a further advantage of the present invention is that the unitary assembly is more cost-effective to manufacture relative to separate assemblies.

Other features and advantages of the present invention will be readily understood as the same becomes better understood after reading the subsequent description when considered in connection with the accompanying drawings.

BRIEF DESCRIPTION OF THE DRAWINGS

FIG. 3 is a perspective rear view of an adjustable pedal assembly of FIG. 1, according to the present invention.

FIG. 4 is a side view of the adjustable pedal assembly of FIG. 1 showing the range of adjustment, according to the present invention.

DESCRIPTION OF THE PREFERRED EMBODIMENTS

Figure 1:
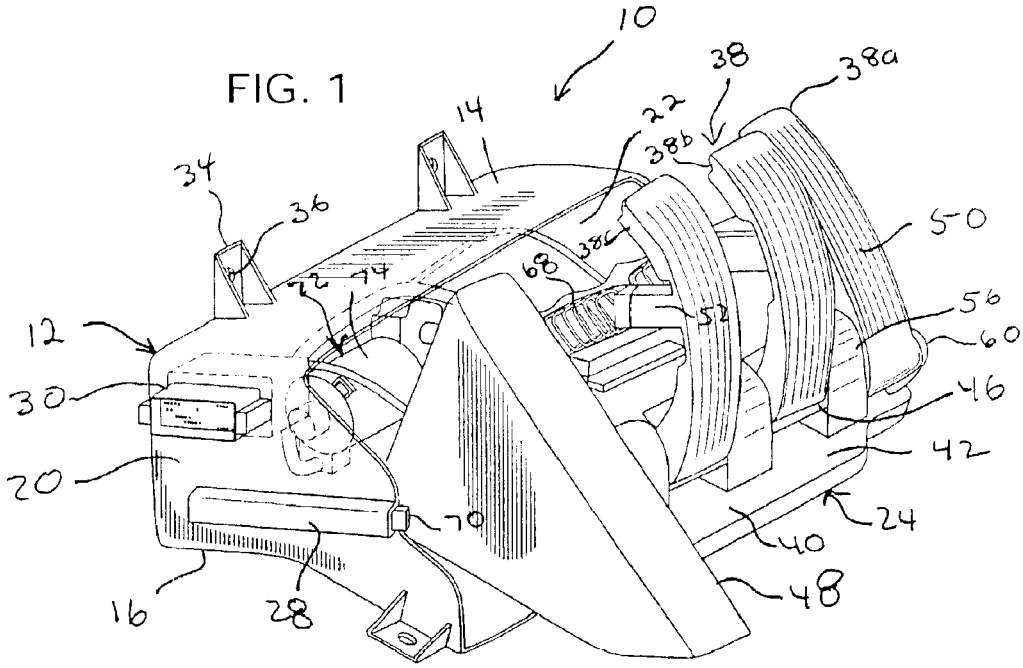
FIG. 1 is a perspective front view of an adjustable pedal assembly in an adjusted position, according to the present invention.

Vehicles, including a motor vehicle (not shown) utilize foot-actuated devices, referred to as pedals, to control a particular function of the vehicle, such as accelerating, braking and shifting. These pedals are referred to in the art as an accelerator pedal, brake pedal, clutch pedal, and parking brake pedal respectively. In addition, the vehicle may include a non-functional pedal that provides a footrest for the non-active foot, such as the left foot in a left-hand drive vehicle. The pedals are aligned in a predetermined dimensional relationship relative to each other, and fixed portions of the vehicle, including the vehicle dash panel, floor, seat and instrument panel. The pedal pad portion of the pedal assembly travels in a predetermined path, typically an arc. Thus, to increase the height of the pedal pad (to be described) with respect to the floor, the pedal pad typically moves along the arc into the vehicle. The pedal height is decreased in a similar manner.

Referring to FIGS. 1–4, an adjustable pedal assembly 10 for transferring a signal between a vehicle operator or driver (not shown) and an actuating mechanism (not shown), for controlling the movement of the vehicle, is illustrated. The pedal assembly 10 includes a support bracket 12 , or mounting base for attaching the pedal assembly 10 to a portion of the vehicle. In this example, the pedal assembly 10 is attached to both the floor of the vehicle and the dash panel.

The support bracket 12 includes a top wall 14, a bottom wall 16 opposite the top wall 14, and a back wall 18 extending between the top wall 14 and the bottom wall 16. The support bracket 12 also includes pair of side walls 20 extending therebetween the top wall 14 and bottom wall 16. It should be appreciated that the top wall 14, bottom wall 16, back wall 18 and side walls 20 cooperatively form an integral member having an opening, shown at 22, through which a carrier bracket 24 moves in a predetermined manner. In this example, the carrier bracket 24 moves linearly with respect to the support bracket 12. However, non-linear movement of the carrier bracket 24 is also contemplated. Each of the side walls 20 further include a longitudinally extending guide slot, for affecting the movement of the carrier bracket 24 with respect to the support bracket 12 in a manner to be described. In this example, a guide channel 28 having a "C" cross sectional shape is formed in the side wall 20 to enclose the guide slot 26.

The support bracket 12 also provides a mounting surface for other mechanisms, such as for an electrical connector 30. In this example, an electronic control module (not shown) for operatively controlling the adjustable pedal assembly 10 is electrically connected to actuators for the pedals via the electrical connector. Wires 32 from the electrical connector 30 carry electric signals between the electric control modules and the actuators for the accelerator, brake, clutch or parking brake pedals respectively. The support bracket 12 also includes tabs 34 for mounting the support bracket 12 to the vehicle. In this example, the tabs 34 extend outwardly from a side wall 20 and a back wall 18 of the support bracket 12, so that the support bracket 12 is fixedly mounted to both the floor of the vehicle and a dash panel portion of the vehicle. The tabs 34 include an aperture and the support bracket 12 is mounted using a fastener (not shown) extending therethrough the aperture 36 in the tab 34, such as a bolt or screw or the like.

The adjustable pedal assembly 10 includes a carrier bracket 24 slidingly attached to the support bracket 12, so that the relative position of each of the pedals 38 is adjustable in a predetermined manner with respect to the driver. For example, the driver typically rests their heel on the floor of the vehicle at a position referred to as the heel point. The pedals 38 may be adjusted so that the pivot point of the pedals 38 is nearer the heel point of the driver. This improves the ergonomic relationship between the driver and the pedals. In addition by placing the pivot point 60 nearer the heel point, there is less scrub or slippage of the foot relative to the pedal 38. The carrier bracket 24 provides a mounting surface for the pedal 38, such as the accelerator pedal 38*a*, brake pedal 38*b* and clutch pedal 38*c* of this example. Although three pedals are illustrated, it is contemplated that the assembly 10 may have a brake pedal 38*b* and an accelerator pedal 38*a*. Alternatively, it is contemplated that the assembly 10 may include a parking brake pedal (not shown) in addition to the other pedals described.

The carrier bracket 24 includes a generally planar shell 40. Preferably the shell 40 is molded of plastic. The shell includes a generally planar inclined front wall 42 joined to a floor 44. The front wall 42 includes an aperture, shown at 46, through which the pedals extend therethrough.

The carrier bracket 24 may includes a foot support 48 integrally formed in the front wall 42 opposite the accelerator pedal 38*a*. In this example, the foot support 48 is formed on the left hand side of the front wall 42, and provides a footrest for the left foot of the vehicle operator when it is not being used to operate one of the pedals.

The adjustable pedal assembly 10 includes a pedal pad 50 attached at a pivot point in an manner to be described. The pedal pad 50 is a generally planar member that is rectangular. The pedal pad 50 has a stop 52 extending radially from a back side 54 of the pedal pad 50. The stop 52 limits the travel of the pedal pad 50. Preferably, the pedal pad 50 is made from an isomeric material, such as rubber.

Figure 2:
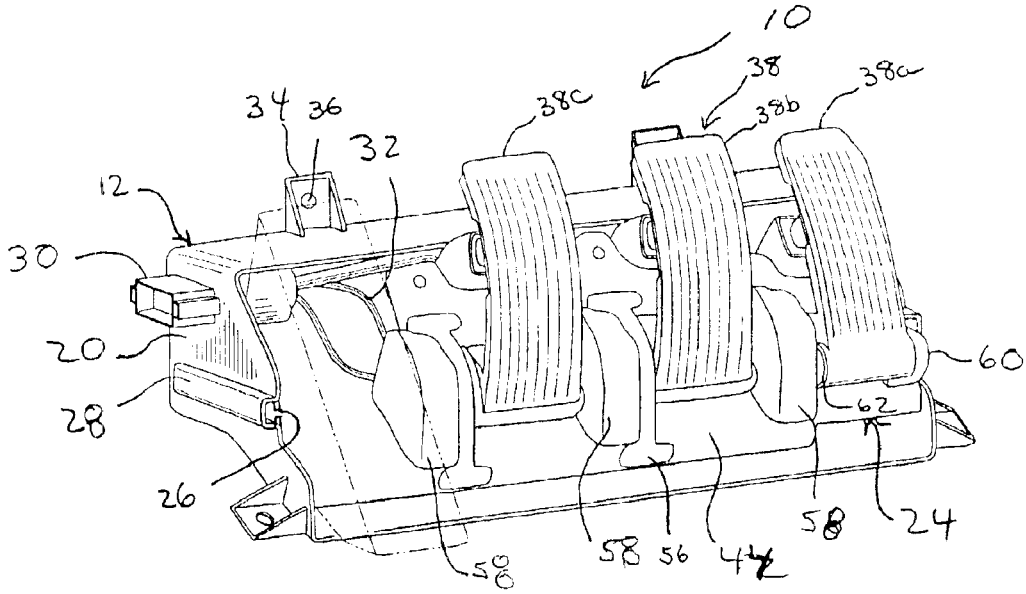
FIG. 2 is a perspective front view of the adjustable pedal assembly of FIG. 1 in a non-adjusted position without the front wall of the carrier bracket, according to the present invention.

Referring to FIG. 2, a cutaway view of the carrier bracket 24, with the front wall 42 removed, is illustrated. The carrier bracket 24 includes a stanchion 56, or wall extend upwardly from the carrier bracket floor 44. Preferably, a wall 56 is positioned between each pedal 38. In this example, an electronic control module 58 is supported on the wall 56 adjacent to an associated pedal 38, and includes all necessary redundancies as well as switching requirements for the assembly 10.

The pedals 38 are pivotally supported along a common axis, shown at 60, or pivot point, such that the pedal pad 50 is positioned to extend upwardly away from the carrier bracket 24. The pivot axis 60 extends longitudinally therealong the carrier bracket floor 44. Preferably, a pivot member 62, such as a pivot pin, is supported between the walls 56, or wall 56 and side wall 20 of the carrier bracket 24 in the case of the outermost pedal, along the common pivot axis 60. The pivot member 62 pivotally supports the foot actuated pedal 38. The pivot member 62 is preferably made from a rigid material such as metal or plastic. In this example the pivot member 62 is fixedly secured to the carrier bracket 24. In an alternative embodiment, the pivot point 60 and thus the pivot member 62 is adjustable relative to respect to the carrier bracket 24. In this example, the adjustment of the pedal pivot point 60 does not change the spatial relationship between the pedals 38.

The carrier bracket 24 also includes an integrally formed box member 64 with an open end 66, extending upwardly from the floor 44 of the carrier bracket 24. This should be appreciated that the box member 64 is configured and positioned to be in-line with the travel of the pedal pad 50. The adjustable pedal assembly 10 includes a spring 68 disposed within the box member. In this example, an upper end of the spring 68 is fixedly attached to the pedal stop 52 portion of the pedal pad 50. A lower end of the spring 68 may be attached to the floor 44 of the carrier bracket 24. The spring 68 provides resistance, and returns the pedal 38 to its proper position when the pedal pad 50 is released by the operator. Preferably, the accelerator pedal 38*a* is biased by the spring 68 at an angle from vertical which is greater than the corresponding angle of the brake pedal 38*b* and clutch pedal 38*c*. In this way, the pedal 38 assumes a consistent position in a manner similar to a standard "organ stop" pedal position.

The pedal assembly 10 may include an electronic position indicator sensor (not shown) mounted on the pivot axis 60 for each pedal 38 to indicate the relative position of the pedal 38 as it is actuated between a resting, and a fully depressed position, and all points inbetween.

The carrier bracket 24 further includes a guide tab 70 extending outwardly and longitudinally therealong the side wall 20 of the carrier bracket 24. In this example, the guide tab 70 has a "T" cross-sectional shape. The guide tab 70 is slidably received through the guide slot 26 and the corresponding guide channel 28 formed in the side wall 20 of the support bracket 12. It should be appreciated that the guide tab 70 and guide channel 28 cooperatively from a track 84 for positioning the carrier bracket 24 relative to the support bracket 12. Various geometric factors may influence the relative movement of the carrier bracket with respect to the support bracket 12 and thus the movement of the pedal 38 with respect to the driver. For example, the length of the track 84 is one factor. Another is the angular orientation of the track. The resulting movement may be linear, or non-linear, depending on the configuration of the track 84.

The pedal assembly 10 also includes an adjustment mechanism. In this example, the adjustment mechanism includes a motor, which is mounted to the bottom wall 16 of the support bracket 12. The motor 74 is operatively connected to a lead screw 76 and trunion 78. The trunion 78 is supported by the carrier bracket 24. The other end of the lead screw 76 is adjacent the front wall 42 of the carrier bracket 24. Alternatively, the other end of the lead screw 76 is fixedly connected to the carrier bracket 24. Enerigation of the motor 74 rotates the lead screw and moves trunion 78 along the lead screw 76 to effectively extend and retract the carrier bracket 24 with respect to the support bracket 12 along the guide track. It should be appreciated that the length of the lead screw may also influence the amount of travel of the carrier bracket with respect to the support bracket. As the carrier bracket 24 is slidingly adjusted along the predetermined path with respect to the driver, the pedal 38 is ergonomically positioned for the driver. Advantageously, the spatial relationship between the pedals 38 is maintained at every pedal adjustment point. As shown in FIG. 4, the carrier bracket is in its fully adjusted position 82 with respect to the support bracket 12. In this example, the pedals are easily accessible to a smaller driver when the carrier bracket is in the fully adjusted position. Likewise, in a non-adjusted position 80 the pedals are easily accessible to a larger driver.

In an alternative embodiment, the pedal angle shown at 86, that is, the angular distance between the pedal pad and the floor 88 of the vehicle, is adjustable. Adjustment of the pedal angle as well as the location of the pivot point of the pedal is advantageous. The pedal pad is ergonomically positioned with respect to the driver's foot. An example of an adjustable pedal angle for a suspended pedal is disclosed in commonly assigned U.S. patent application Ser. No. 09/882,981 filed Jun. 15, 2001.

It should also be appreciated that the adjustable brake pedal assembly 10 may include other component parts, such as switches (not shown), which are conventional and known in the art for the adjustable brake pedal assembly 10.

The present invention has been described in an illustrative manner. It is to be understood that the terminology which has been used is intended to be in the nature of words of description rather than of limitation. Many modifications and variations of the present invention are possible in light of the above teachings. Therefore, within the scope of the appended claims, the present invention may be practiced other than as specifically described.

What is claimed is:

1. An adjustable pedal assembly for a vehicle comprising:

a support bracket adapted for fixedly mounting on a vehicle, wherein the support bracket includes a top wall, a bottom wall opposite the top wall, a back wall extending between the top wall and bottom wall, and a pair of opposed side walls extending between the top wall and bottom wall;

a carrier bracket slidingly supported by said support bracket, wherein said carrier bracket includes a generally inclined front wall, a floor extending from a lower edge of said front wall, and a pair of opposed side walls extending between said front wall and said floor;

a pedal pivotally attached to said carrier bracket along a pivot axis, wherein said pivot axis extends longitudinally therealong said carrier bracket; and a pedal adjustment mechanism operatively attached to said carrier bracket for adjusting the position of said carrier bracket relative to said support bracket to adjust the position of said pedal along a predetermined path.

2. A pedal assembly as set forth in claim 1, further including a pedal travel limiting means for limiting the travel of said pedal, wherein said pedal travel limiting means includes a box member extending upwardly from the floor of said carrier bracket, a spring disposed in the box member, and a pedal stop extending radially outward from a back side of said pedal, such that said pedal stop is operatively disposed within said box member.

3. A pedal assembly as set forth in claim 1 wherein said side wall of said support bracket includes a longitudinally extending guide slot, and said side wall of said carrier bracket includes a longitudinally extending guide tab, such that said guide tab is slidingly engaged in the guide slot.

4. A pedal assembly as set forth in claim 3 wherein said guide tab has a "T" cross-sectional shape.

5. A pedal assembly as set forth in claim 4 wherein said side wall of said support bracket includes a longitudinally extending guide channel integrally formed in said side wall to enclose said guide slot.

6. A pedal assembly as set forth in claim 1 wherein said support bracket includes tabs for securing said support bracket to the vehicle.

7. A pedal assembly as set forth in claim 1 wherein said carrier bracket includes at least one stanchion extending upwardly from the floor of said carrier bracket for pivotally mounting said pedal thereto at said pivot point.

8. A pedal assembly as set forth in claim 1 wherein said carrier bracket includes an integrally formed foot rest in said front wall.

9. A pedal assembly as set forth in claim 1 wherein said adjustment mechanism further comprises:

a motor fixedly mounted to said support bracket;

a lead screw operatively connected to said motor; and a trunion having a central portion and a transverse portion, wherein said central portion is rotatingly disposed on said lead screw and said transversely extending portion is fixedly attached to said carrier bracket, for positioning said carrier plate with respect to said support bracket when said motor is energized.

10. A pedal assembly as set forth in claim 1 wherein said pedal includes an accelerator pedal and a brake pedal having a predetermined spatial relationship, and said accelerator pedal and said brake pedal are adjustable with respect to the driver, such that the predetermined spatial relationship between the accelerator pedal and brake pedal does not vary.

11. A pedal assembly as set forth in claim 1 wherein said pedal includes an accelerator pedal, a brake pedal and a clutch pedal having a predetermined spatial relationship, and said accelerator pedal, said brake pedal, and said clutch pedal are adjustable with respect to the driver, such that the predetermined spatial relationship between the accelerator pedal, brake pedal and clutch pedal does not vary.

12. An adjustable pedal assembly for a vehicle comprising:

a support bracket adapted for fixedly mounting on a vehicle, wherein the support bracket includes a top wall, a bottom wall opposite the top wall, a back wall extending between the top wall and bottom wall, and a pair of opposed side walls extending between the top wall and bottom wall;

a carrier bracket slidingly supported by said support bracket, wherein said carrier bracket includes a generally inclined front wall, a floor extending from a lower edge of said front wall, and a pair of opposed side walls extending between said front wall and said floor;

a plurality of pedals pivotally attached to said carrier bracket along a pivot axis extending longitudinally therealong said carrier bracket, wherein each of said pedals is a rectangular member with a pedal stop positioned on a back side for limiting travel, and a lower edge of each of said pedals is pivotally attached to said carrier bracket such that a predetermined spatial relationship is maintained between each of said pedals; and a pedal adjustment mechanism operatively attached to said carrier bracket, for adjusting the position of said carrier bracket relative to said support bracket to adjust the position of each of said pedals along a predetermined path while maintaining the predetermined spatial relationship between each of said pedals.

13. A pedal assembly as set forth in claim 12, further including a pedal travel limiting means, wherein said pedal travel limiting means includes a box member extending upwardly from said floor of the carrier bracket, and a spring disposed in said box member, such that said pedal stop is operatively disposed within said box member.

14. A pedal assembly as set forth in claim 12 wherein said side wall of said support bracket includes a longitudinally extending guide slot, and said side wall of said carrier bracket includes a longitudinally extending guide tab, such that said guide tab is slidingly engaged in the guide slot.

15. A pedal assembly as set forth in claim 14 wherein said guide tab has a "T" cross-sectional shape.

16. A pedal assembly as set forth in claim 15 wherein said side wall of said support bracket includes a longitudinally extending guide channel integrally formed in said side wall to enclose said guide slot.

17. A pedal assembly as set forth in claim 12 wherein said support bracket includes tabs for securing said support bracket to the vehicle.

18. A pedal assembly as set forth in claim 12 wherein said carrier bracket includes at least one stanchion extending upwardly from said floor of said carrier bracket for pivotally mounting each of said pedals thereto at said pivot point.

19. A pedal assembly as set forth in claim 12 wherein said carrier bracket includes an integrally formed foot rest in said front wall.

20. A pedal assembly as set forth in claim 12 wherein said adjustment mechanism further comprises:

a motor fixedly mounted to said support bracket;

a lead screw operatively connected to said motor; and a trunion having a central portion and a transverse portion, wherein said central portion is rotatingly disposed on said lead screw and said transversely extending portion is fixedly attached to said carrier bracket, for positioning said carrier plate with respect to said support bracket when said motor is energized.

21. A pedal assembly as set forth in claim 12 wherein said plurality of pedals includes an accelerator pedal and a brake pedal, and said accelerator pedal and said brake pedal are adjustable with respect to the driver, such that the predetermined spatial relationship between the accelerator pedal and brake pedal does not vary.

22. A pedal assembly as set forth in claim 12 wherein said plurality of pedals includes an accelerator pedal, a brake pedal and a clutch pedal, and said accelerator pedal, said brake pedal, and said clutch pedal are adjustable with respect to the driver, such that the predetermined spatial relationship between the accelerator pedal, brake pedal and clutch pedal does not vary.

23. An adjustable pedal assembly for a vehicle comprising:

a support bracket adapted for fixedly mounting on a vehicle, wherein the support bracket includes a top wall, a bottom wall opposite the top wall, a back wall extending between the top wall and bottom wall, and a pair of opposed side walls extending between said top wall and bottom wall, and said side walls have a longitudinally extending guide slot;

a carrier bracket slidingly supported by said support bracket, wherein said carrier bracket includes a generally inclined front wall, a floor extending from a lower edge of the front wall, and a pair of opposed side walls extending between the front wall and the floor, and said side wall of said carrier bracket includes a longitudinally extending guide tab, and said guide tab is slidingly engaged in the guide slot;

a plurality of pedals pivotally attached to said carrier bracket along a pivot axis extending longitudinally therealong said carrier bracket, wherein each of said pedals is a rectangular member with a pedal stop positioned on a back side for limiting travel, and a lower edge of each of said pedals is pivotally attached to said carrier bracket such that a predetermined spatial relationship is maintained between each of said pedals;

a pedal travel limiting means positioned on said carrier bracket for limiting the travel of each of said pedals; and a pedal adjustment mechanism operatively attached to said carrier bracket, for adjusting the position of said pedal carrier bracket relative to said support bracket to adjust the position of each of said pedals along a predetermined path while maintaining the predetermined spatial relationship between each of said pedals.

24. A pedal assembly as set forth in claim 23, wherein said pedal travel limiting means includes a box member extending upwardly from the floor of said carrier bracket, and a spring disposed in said box member, such that said pedal stop is operatively disposed within said box member.

25. A pedal assembly as set forth in claim 23 wherein said side wail of said support bracket includes a longitudinally extending guide channel integrally formed in said side wall to enclose said guide slot.

26. A pedal assembly as set forth in claim 25 wherein said guide tab has a "T" cross-sectional shape.

27. A pedal assembly as set forth in claim 23 wherein said support bracket includes tabs for securing the support bracket to the vehicle.

28. A pedal assembly as set forth in claim 23 wherein said carrier bracket includes at least one stanchion extending upwardly from said floor of said carrier bracket for pivotally mounting each of said pedals thereto at said pivot point.

29. A pedal assembly as set forth in claim 23 wherein said carrier bracket includes an integrally formed foot rest in said front wall.

30. A pedal assembly as set forth in claim 23 wherein said adjustment mechanism further comprises:

a motor fixedly mounted to said support bracket;

a lead screw operatively connected to said motor; and a trunion having a central portion and a transverse portion, wherein said central portion is rotatingly disposed on said lead screw and said transversely extending portion is fixedly attached to said carrier bracket, for positioning said carrier plate with respect to said support bracket when said motor is energized.

31. A pedal assembly as set forth in claim 23 wherein said pluraliy of pedals includes an accelerator pedal and a brake pedal, and said accelerator pedal and said brake pedal are adjustable with respect to the driver, such that the predetermined spatial relationship between the accelerator pedal and brake pedal does not vary.

32. A pedal assembly as set forth in claim 23 wherein said plurality of pedals includes an accelerator pedal, a brake pedal and a clutch pedal, and said accelerator pedal, said brake pedal, and said clutch pedal are adjustable with respect to the driver, such that the predetermined spatial relationship between the accelerator pedal, brake pedal and clutch pedal does not vary.

* * * * *